US005210002A

United States Patent [19]

Adin

[11] Patent Number: 5,210,002

[45] Date of Patent: May 11, 1993

[54] NUCLEATED HIGH CONTRAST PHOTOGRAPHIC ELEMENTS CONTAINING UREA COMPOUNDS WHICH ENHANCE SPEED AND INCREASE CONTRAST

[75] Inventor: Anthony Adin, Rochester, N.Y.

[73] Assignee: Eastman Kodak Company, Rochester, N.Y.

[21] Appl. No.: 735,979

[22] Filed: Jul. 25, 1991

[51] Int. Cl.[5] ..... G03C 1/06

[52] U.S. Cl. ..... 430/264; 430/604; 430/605; 430/598; 430/603

[58] Field of Search ..... 430/264, 604, 605, 598, 430/603

[56] References Cited

U.S. PATENT DOCUMENTS

| | | | |
|---|---|---|---|
| 3,297,446 | 1/1967 | Dunn | 430/613 |
| 4,168,977 | 9/1979 | Takada et al. | 96/63 |
| 4,686,167 | 8/1987 | Resnick et al. | 430/264 |
| 4,810,626 | 3/1989 | Burgmaier et al. | 430/603 |
| 4,933,273 | 6/1990 | Gilman et al. | 430/597 |
| 4,962,017 | 10/1990 | Nakamura | 430/551 |
| 4,975,354 | 12/1990 | Machonkin et al. | 430/264 |
| 4,988,604 | 1/1991 | Machonkin et al. | 430/264 |
| 5,041,355 | 8/1991 | Machonkin et al. | 430/264 |
| 5,049,485 | 9/1991 | Deaton | 430/605 |
| 5,104,769 | 4/1992 | Looker et al. | 430/264 |
| 5,126,227 | 6/1992 | Machonkin et al. | 430/264 |

*Primary Examiner*—Charles L. Bowers, Jr.
*Assistant Examiner*—Thomas R. Neville
*Attorney, Agent, or Firm*—Alfred P. Lorenzo

[57] ABSTRACT

Silver halide photographic elements which are capable of high-contrast development and are especially useful in the field of graphic arts comprise surface latent image forming high-chloride silver halide grains and have incorporated therein a hydrazine compound which functions as a nucleator, an amino compound which functions as an incorporated booster, and a combination of a gold compound and a urea compound which functions as a chemical sensitizer. Urea compounds effective for this purpose are 1,1,3,3-tetra-substituted middle chalcogen urea compounds in which at least one substituent comprises a nucleophilic center.

19 Claims, No Drawings

NUCLEATED HIGH CONTRAST PHOTOGRAPHIC ELEMENTS CONTAINING UREA COMPOUNDS WHICH ENHANCE SPEED AND INCREASE CONTRAST

FIELD OF THE INVENTION

This invention relates in general to photography and in particular to novel black-and-white photographic elements. More specifically, this invention relates to novel nucleated silver halide photographic elements which are capable of high contrast development and are especially useful in the field of graphic arts.

BACKGROUND OF THE INVENTION

U.S. Pat. No. 4,975,354 issued Dec. 4, 1990, entitled "Photographic Element Comprising An Ethyleneoxy-Substituted Amino Compound And Process Adapted To Provide High Contrast Development", by Harold I. Machonkin and Donald L. Kerr, describes silver halide photographic elements having incorporated therein a hydrazine compound which functions as a nucleator and an amino compound which functions as an incorporated booster. Such elements provide a highly desirable combination of high photographic speed, very high contrast and excellent dot quality, which renders them very useful in the field of graphic arts. Moreover, since they incorporate the booster in the photographic element, rather than using a developing solution containing a booster, they have the further advantage that they are processable in conventional, low cost, rapid-access developers.

While the high-contrast photographic elements of U.S. Pat. No. 4,975,354 represent a major advance in the art, there is a continuing need to improve the properties of these photographic elements, for example, to provide increased photographic speed and even higher contrast. Moreover, enhanced developability of these high-contrast elements, which would enable the use of very short development times, would also be highly beneficial in the field of graphic arts.

It is a well known expedient to increase photographic speed by the use of chemical sensitizing agents, and a very wide variety of different compounds are known to be useful as chemical sensitizers (see, for example, Research Disclosure, Issue No. 308, Item 308119, Paragraph III, December, 1989). However, the use of chemical sensitizing agents can adversely affect other properties of silver halide emulsions which contain a hydrazine compound that functions as a nucleator and an amino compound that functions as an incorporated booster, for example, it can adversely affect contrast or result in an increase in fog.

It is toward the objective of providing an improved high-contrast photographic element—containing both a hydrazine compound that functions as a nucleator and an amino compound that functions as an incorporated booster—that has enhanced developability and that exhibits increased speed and increased toe contrast, without a concurrent increase in fog, that the present invention is directed.

SUMMARY OF THE INVENTION

The present invention provides novel silver halide photographic elements which are adapted to form a high-contrast image when development is carried out with an aqueous alkaline developing solution. The novel photographic elements of this invention comprise:

(1) surface latent image forming high-chloride silver halide grains, (2) a hydrazine compound that functions as a nucleator, (3) an amino compound that functions as an incorporated booster, (4) a gold compound that functions as a chemical sensitizer, and (5) a urea compound that functions as a chemical sensitizer, said urea compound being a 1,1,3,3-tetrasubstituted middle chalcogen urea compound in which at least one substituent comprises a nucleophilic center.

Use of high-chloride silver halide grains in the photographic elements of this invention promotes nucleatability and provides enhanced developability which renders feasible the use of very short development times and moderate development temperatures. While effective chemical sensitization of such high-chloride emulsions is typically very difficult to achieve, it is accomplished in this invention by the use, as chemical sensitizers, of the combination of a gold compound with the aforesaid urea compound. This combination unexpectedly provides the desired characteristics of high speed and high contrast without an increase in fog.

DESCRIPTION OF THE PREFERRED EMBODIMENTS

Any hydrazine compound that functions as a nucleator, is capable of being incorporated in the photographic element, and is capable of acting conjointly with the incorporated booster to provide high contrast, can be used in the practice of this invention. Typically, the hydrazine compound is incorporated in a silver halide emulsion used in forming the photographic element. Alternatively, the hydrazine compound can be present in a hydrophilic colloid layer of the photographic element, preferably a hydrophilic colloid layer which is coated to be contiguously adjacent to the emulsion layer in which the effects of the hydrazine compound are desired. It can, of course, be present in the photographic element distributed between or among emulsion and hydrophilic colloid layers, such as undercoating layers, interlayers and overcoating layers.

An especially preferred class of hydrazine compounds for use in the elements of this invention are the hydrazine compounds described in Machonkin et al, U.S. Pat. No. 4,912,016 issued Mar. 27, 1990,. These compounds are aryl hydrazides of the formula:

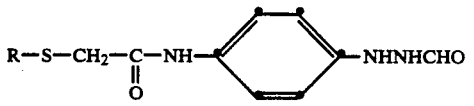

where R is an alkyl or cycloalkyl group.

Another especially preferred class of hydrazine compounds for use in the elements of this invention are the hydrazine compounds described in copending commonly assigned U.S. Patent application Ser. No. 167,814, "High Contrast Photographic Element and Emulsion And Process For Their Use", by J. J. Looker, R. E. Leone and L. J. Fleckenstein, filed Mar. 14, 1988 and issued Apr. 14, 1992, as U.S. Pat. No. 5,104,769.

The disclosure of this application is incorporated herein by reference in its entirety.

The hydrazine compounds described in the aforesaid patent application Ser. No. 167,814 have one of the following structural formulae:

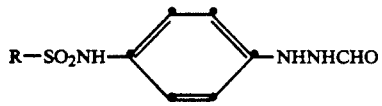

I

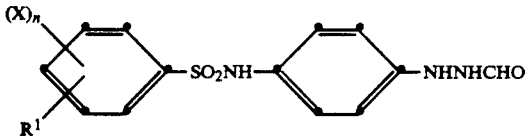

II wherein:

R is alkyl having from 6 to 18 carbon atoms or a heterocylic ring having 5 or 6 ring atoms, including ring atoms of sulfur or oxygen;

$R^1$ is alkyl or alkoxy having from 1 to 12 carbon atoms;

X is alkyl, thioalkyl or alkoxy having from 1 to about 5 carbon atoms; halogen; or $—NHCOR^2$, $—NHSO_2R^2$, $—CONR^2R^3$ or $—SO_2NR^2R^3$ where $R^2$ and $R^3$, which can be the same or different, are hydrogen or alkyl having from 1 to about 4 carbon atoms; and n is 0, 1 or 2.

Alkyl groups represented by R can be straight or branched chain and can be substituted or unsubstituted. Substituents include alkoxy having from 1 to about 4 carbon atoms, halogen atoms (e.g. chlorine and fluorine), or $—NHCOR^2$ or $—NHSO_2R^2$ where $R^2$ is as defined above. Preferred R alkyl groups contain from about 8 to about 16 carbon atoms since alkyl groups of this size impart a greater degree of insolubility to the hydrazide nucleating agents and thereby reduce the tendency of these agents to be leached during development from the layers in which they are coated into developer solutions.

Heterocyclic groups represented by R include thienyl and furyl, which groups can be substituted with alkyl having from 1 to about 4 carbon atoms or with halogen atoms, such as chlorine.

Alkyl or alkoxy groups represented by $R^1$ can be straight or branched chain and can be substituted or unsubstituted. Substituents on these groups can be alkoxy having from 1 to about 4 carbon atoms, halogen atoms (e.g. chlorine or fluorine); or $—NHCOR^2—$ or $—NHSO_2R^2$ where $R^2$ is as defined above. Preferred alkyl or alkoxy groups contain from 1 to 5 carbon atoms in order to impart sufficient insolubility to the hydrazide nucleating agents to reduce their tendency to being leached out of the layers in which they are coated by developer solution.

Alkyl, thioalkyl and alkoxy groups which are represented by X contain from 1 to about 5 carbon atoms and can be straight or branched chain. When X is halogen, it may be chlorine, fluorine, bromine or iodine. Where more than one X is present, such substituents can be the same or different.

Yet another especially preferred class of hydrazine compounds are aryl sulfonamidophenyl hydrazides containing ethyleneoxy groups which have the formula:

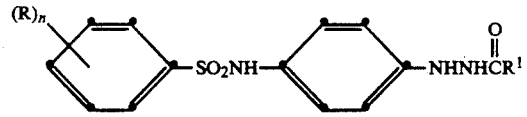

II where each R is a monovalent group comprised of at least three repeating ethyleneoxy units, n is 1 to 3, and $R^1$ is hydrogen or a blocking group.

These hydrazides are described in copending commonly assigned U.S. patent application Ser. No. 528,651, "High Contrast Photographic Element Including An Aryl Sulfonamidophenyl Hydrazide Containing Ethyleneoxy Groups", by H. I. Machonkin and D. L. Kerr, filed May 24, 1990 and issued Aug. 20, 1991, as U.S. Pat. No. 5,041,355, the disclosure of which is incorporated herein by reference in its entirety.

Still another especially preferred class of hydrazine compounds are the compounds described in Machonkin and Kerr, U.S. Pat. No. 4,988,604 issued Jan. 29, 1991. These compounds are aryl sulfonamidophenyl hydrazides containing both thio and ethyleneoxy groups which have the formula:

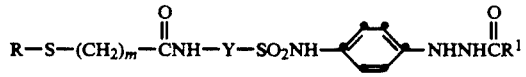

where R is a monovalent group comprised of at least three repeating ethyleneoxy units, m is 1 to 6, Y is a divalent aromatic radical, and $R^1$ is hydrogen or a blocking group. The divalent aromatic radical represented by Y, such as a phenylene radical or naphthalene radical, can be unsubstituted or substituted with one or more substituents such as alkyl, halo, alkoxy, haloalkyl or alkoxyalkyl.

A still further especially preferred class of hydrazine compounds are the compounds described in Looker and Kerr, U.S. Pat. No. 4,994,365, issued Feb. 19, 1991. These compounds are aryl sulfonamidophenyl hydrazides containing an alkyl pyridinium group which have the formula:

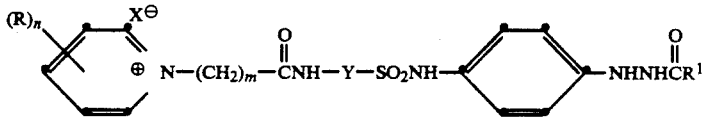

where each R is an alkyl group, preferably containing 1 to 12 carbon atoms, n is 1 to 3, X is an anion such as chloride or bromide, m is 1 to 6, Y is a divalent aromatic radical, and $R^1$ is hydrogen or a blocking group. The divalent aromatic radical represented by Y, such as a phenylene radical or naphthalene radical, can be unsubstituted or substituted with one or more substituents such as alkyl, halo, alkoxy, haloalkyl or alkoxyalkyl. Preferably, the sum of the number of carbon atoms in the alkyl groups represented by R is at least 4 and more preferably at least 8. The blocking group represented by $R^1$ can be, for example:

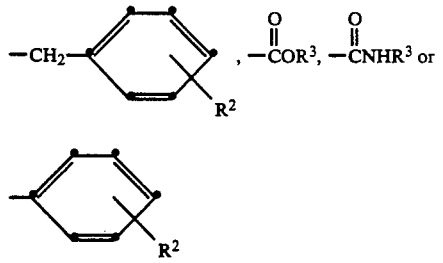

where $R^2$ is hydroxy or a hydroxy-substituted alkyl group having from 1 to 4 carbon atoms and $R^3$ is an alkyl group having from 1 to 4 carbon atoms.

While certain preferred hydrazine compounds that are useful in this invention have been specifically described hereinabove, it is intended to include within the scope of this invention all hydrazine compound "nucleators" known to the art. Many such nucleators are described in "Development Nucleation By Hydrazine And Hydrazine Derivatives", Research Disclosure, Item 23510, Vol. 235, Nov. 10, 1983 and in numerous patents including U.S. Pat. Nos. 4,166,742, 4,168,977, 4,221,857, 4,224,401, 4,237,214, 4,241,164, 4,243,739, 4,269,929, 4,272,606, 4,272,614, 4,311,781, 4,332,878, 4,358,530, 4,377,634, 4,385,108, 4,429,036, 4,447,522, 4,540,655, 4,560,638, 4,569,904, 4,618,572, 4,619,886, 4,634,661, 4,650,746, 4,681,836, 4,686,167, 4,699,873, 4,722,884, 4,725,532, 4,737,442, 4,740,452, 4,912,016 4,914,003, 4,975,354, 4,988,604 and 4,994,365.

The hydrazine compound utilized as a nucleator in this invention is usually employed in an amount of from about 0.005 millimoles to about 100 millimoles per mole of silver and more typically from about 0.1 millimoles to about 10 millimoles per mole of silver.

The nucleated high-contrast photographic elements of this invention utilize surface latent image forming high-chloride silver halide grains. By the term "high-chloride silver halide grains", as used herein, is meant silver halide grains in which at least the surface portion is composed of more than 50 mole percent silver chloride. Both conventional grains which are more than 50 percent silver chloride and grains of the core-shell type in which the shell is more than 50 percent silver chloride, can be employed with satisfactory results. Preferably, the silver halide grains utilized in this invention are at least 70 mole percent chloride. Use of high-chloride silver halide grains is highly advantageous in promoting the developability of the high contrast element, and thereby providing for the short development times that are critically needed in the field of graphic arts.

Preferably, the silver halide grains are monodispersed and have a mean grain size of not larger than about 0.7 micrometers, and more preferably of about 0.4 micrometers or less.

Typically, the silver laydown is in the range of from about 0.5 to about 10 grams per square meter, and preferably in the range of from about 2 to about 5 grams per square meter.

As described hereinabove, the silver halide grains utilized in this inventon are capable of forming a surface latent image, as opposed to being of the internal latent image forming type. Thus, the silver halide emulsion layer is negative working. The silver halide grains can be of any suitable geometric form, e.g., regular cubic or octahedral crystalline forms. It is particularly preferred that the silver halide grains are doped to provide high contrast. As is known in the art, use of a suitable doping agent, in concert with the use of a hydrazine compound that functions as a nucleator, is capable of providing an extremely high contrast response. Doping agents are typically added during the crystal growth stages of emulsion preparation, for example, during initial precipitation and/or physical ripening of the silver halide grains. Rhodium is a particularly effective doping agent, and can be incorporated in the grains by use of suitable salts such as rhodium trichloride. Rhodium-doping of the high-chloride silver halide grains employed in this invention is especially beneficial in facilitating the use of chemical sensitizing agents without encountering undesirably high levels of pepper fog. Doping agents described in McDugle et al, U.S. Pat. No. 4,933,272 as being useful in graphic arts emulsions, can also be advantageously employed. These are hexacoordinated complexes of the formula:

$$[M'(NO)(L')_5]^m$$

wherein m is zero, −1, −2, or −3.

M' represents chromium, rhenium, ruthenium, osmium or iridium and L' represents one or a combination of halide and cyanide ligands or a combination of these ligands with up to two aquo ligands.

As an alternative to the use of a doping agent, an electron-accepting antifogging dye can be incorporated in the emulsion. Such dyes and their use in nucleated photographic elements are described in Gilman et al, U.S. Pat. No. 4,933,273.

Silver halide emulsions contain, in addition to silver halide grains, a binder. The proportion of binder can be widely varied, but typically is within the range of from about 20 to 250 grams per mol of silver halide. Excessive binder can have the effect of reducing maximum densities and consequently also reducing contrast. For contrast values of 10 or more it is preferred that the binder be present in a concentration of 250 grams per mol of silver halide, or less.

The binders of the emulsions can be comprised of hydrophilic colloids. Suitable hydrophilic materials include both naturally occurring substances such as proteins, protein derivatives, cellulose derivatives, e.g., cellulose esters, gelatin, e.g., alkali-treated gelatin (pigskin gelatin), gelatin derivatives, e.g., acetylated gelatin, phthalated gelatin and the like, polysaccharides such as dextran, gum arabic, zein, casein, pectin, collagen derivatives, collodion, agar-agar, arrowroot, albumin and the like.

In addition to hydrophilic colloids the emulsion binder can be optionally comprised of synthetic polymeric materials which are water insoluble or only slightly soluble, such as polymeric latices. These materials can act as supplemental grain peptizers and carriers, and they can also advantageously impart increased dimensional stability to the photographic elements. The synthetic polymeric materials can be present in a weight ratio with the hydrophilic colloids of up to 2:1. It is generally preferred that the synthetic polymeric materials constitute from about 20 to 80 percent by weight of the binder.

Suitable synthetic polymer materials can be chosen from among poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridines, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides and the like.

Although the term "binder" is employed in describing the continuous phase of the silver halide emulsions, it is recognized that other terms commonly employed by those skilled in the art, such as carrier or vehicle, can be interchangeably employed. The binders described in connection with the emulsions are also useful in forming undercoating layers, interlayers and overcoating layers of the photographic elements of the invention. Typically the binders are hardened with one or more hardeners, such as those described in Paragraph VII, Product Licensing Index, Vol. 92, December 1971, Item 9232, which disclosure is hereby incorporated by reference.

The silver halide emulsions utilized in this invention can be spectrally sensitized with dyes from a variety of classes, including the polymethine dye class, which includes the cyanines, merocyanines, complex cyanines and merocyanines (i.e., tri-, tetra-and polynuclear cyanines and merocyanines), oxonols, hemioxonols, styryls, merostyryls and streptocyanines.

The high-contrast photographic elements of this invention can, optionally, contain, for the purpose of reducing pepper fog and controlling image spread, a thioether compound as described in copending commonly-assigned U.S. patent application Ser. No. 735,975 filed Jul. 25, 1991, "Nucleated High Contrast Photographic Elements Containing Thioether Compounds To Inhibit Pepper Fog And Restrain Image Spread", by H. I. Machonkin and D. L. Kerr. These are compounds which are free of both hydrazino and amino functionality and which:

(1) contain within their structure at least one thio (—S—) group,
(2) contain within their structure a group comprised of at least three repeating ethyleneoxy units, and
(3) have a partition coefficient (as herein defined) of at least one. Preferred thioether compounds are those of the formula:

$$R—S—(CH_2CH_2O)_n—R'$$

wherein R and R' are monovalent organic radicals which can be the same or different and n is an integer with a value of from 3 to 50, and more preferably from 10 to 30.

As an alternative to the use of the thioether compounds described above, control of pepper fog and image spread can be achieved in this invention by the use of hydrophobic isothiourea compounds as described in copending commonly-assigned U.S. patent application Ser. No. 599,218, filed Oct. 17, 1990, "High Contrast Photographic Elements Containing Ballasted Hydrophobic Isothioureas", by Harold I. Machonkin and Donald L. Kerr and issued Jun. 30, 1992, as U.S. Pat. No. 5,126,227, the disclosure of which is incorporated herein by reference.

These are compounds which have a partition coefficient (as hereinafter defined) of at least one and comprise a ballasting group, attached to the sulfur atom, which serves to restrict the mobility of the compound and thereby aid in retaining it in the photographic element during development. Preferred hydrophobic isothiourea compounds are those represented by the formula:

$$HN{=}\underset{\underset{NH_2}{|}}{C}—S—R$$

wherein R is a ballasting group that contains at least six carbon atoms and is substantially free of solubilizing groups.

It is well known that addition to an emulsion of a small amount of an iodide, such as potassium iodide, after formation of the silver halide grains can increase the speed of a high-contrast photographic element containing a hydrazine compound that functions as a nucleator (see, for example, U.S. Pat. No. 4,168,977). However, as demonstrated in the examples herein, the increase in speed resulting from addition of an iodide may, depending on the particular emulsion employed, be achieved at the expense of an increase in fog and a reduction in contrast in the toe region of the sensitometric curve. Unlike potassium iodide, the sensitizing combination of this invention—namely the combination of the gold compound and the urea compound—is not dependent for its effectiveness on the type of silver halide emulsion utilized.

The photographic system to which this invention pertains is one which employs a hydrazine compound as a nucleating agent and an amino compound as an incorporated booster. Amino compounds which are particularly effective as incorporated boosters are described in Machonkin and Kerr, U.S. Pat. No. 4,975,354, issued Dec. 4, 1990.

The amino compounds useful as incorporated boosters described in U.S. Pat. No. 4,975,354 are amino compounds which:

(1) comprise at least one secondary or tertiary amino group;
(2) contain within their structure a group comprised of at least three repeating ethyleneoxy units, and
(3) have a partition coefficient (as hereinafter defined) of at least one, preferably at least three, and most preferably at least four.

Included within the scope of the amino compounds utilized in this invention as incorporated boosters and monoamines, diamines and polyamines. The amines can be aliphatic amines or they can include aromatic or heterocyclic moieties. Aliphatic, aromatic and heterocyclic groups present in the amines can be substituted or unsubstituted groups. Preferably, the amino compounds employed in this invention as incorporated boosters are compounds of at least 20 carbon atoms.

Preferred amino compounds for use as incorporated boosters are bis-tertiary-amines which have a partition coefficient of at least three and a structure represented by the formula:

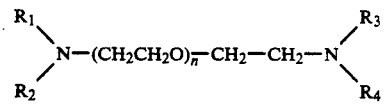

wherein n is an integer with a value of 3 to 50, and more preferably 10 to 50, $R_1$, $R_2$, $R_3$ and $R_4$ are, independently, alkyl groups of 1 to 8 carbon atoms, $R_1$ and $R_2$ taken together represent the atoms necessary to complete a heterocyclic ring, and $R_3$ and $R_4$ taken together represent the atoms necessary to complete a heterocyclic ring.

Another advantageous group of amino compounds for use as incorporated boosters are bis-secondary amines which have a partition coefficient of at least three and a structure represented by the formula:

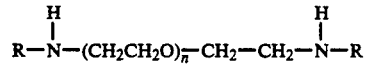

wherein n is an integer with a value of 3 to 50, and more preferably 10 to 50, and each R is, independently, a linear or branched, substituted or unsubstituted, alkyl group of at least 4 carbon atoms.

Preferably the group comprised of at least three repeating ethyleneoxy units is directly linked to a tertiary amino nitrogen atom and most preferably the group comprised of at least three repeating ethyleneoxy units is a linking group joining tertiary amino nitrogen atoms of a bis-tertiary-amino compound.

The most preferred amino compound for use in this invention as an incorporated booster is a compound of the formula:

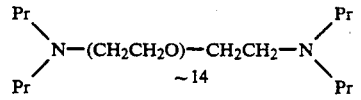

where Pr represents n-propyl.

Other amino compounds useful as incorporated boosters are described in Yagihara et al, U.S. Pat. No. 4,914,003 issued Apr. 3, 1990. The amino compounds described in this patent are represented by the formula:

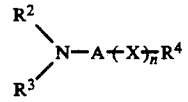

wherein $R^2$ and $R^3$ each represent a substituted or unsubstituted alkyl group or may be linked to each other to form a ring; $R^4$ represents a substituted or unsubstituted alkyl, aryl or heterocyclic group; A represents a divalent linkage; X represents —$CONR^5$—, —O—$CONR^5$, —$NR^5CONR^5$—, —$NR^5COO$—, —COO—, —OCO—, —CO—, —$NR^5CO$—, —$SO_2NR^5$—, —$NR^5SO_2$—, —$SO_2$—, —S—or —O— group in which $R^5$ represents a hydrogen atom or a lower alkyl group and n represents 0 or 1, with the proviso that the total number of carbon atoms contained in $R^2$, $R^3$, $R^4$ and A is 20 or more.

The amino compound utilized as an incorporated booster is typically employed in an amount of from about 0.1 to about 25 millimoles per mole of silver, and more preferably in an amount of from about 0.5 to about 15 millimoles per mole of silver.

Particularly preferred sensitizing dyes for use in this invention are the benzimidazolocarbocyanine dyes described in copending commonly assigned U.S. patent application Ser. No. 735,484, filed Jul. 25, 1991, "Nucleated High Contrast Photographic Elements Containing Low-Stain Sensitizing Dyes", by Anthony Adin, Linda J. Knapp, and Steven G. Link. These dyes provide enhanced photographic sensitivity, yet leave substantially no sensitizing dye stain after rapid access processing.

The benzimidazolocarbocyanine sensitizing dyes described in the aforesaid patent application are benzimidazolocarbocyanine sensitizing dyes having at least one acid-substituted alkyl group attached to a nitrogen atom of a benzimidazole ring. Preferred examples of such dyes are those of the formula:

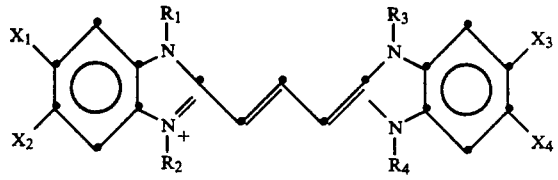

wherein $X_1$, $X_2$, $X_3$ and $X_4$ are, independently, hydrogen, cyano, alkyl, halo, haloalkyl, alkylthio, alkoxycarbonyl, aryl or substituted or unsubstituted carbamoyl;

$R_1$ and $R_3$ are alkyl; and $R_2$ and $R_4$ are, independently, alkyl, alkenyl, substituted alkyl or substituted alkenyl, with the proviso that at least one of $R_2$ and $R_4$ is acid-substituted alkyl, and with the further proviso that when both $R_2$ and $R_4$ are acid-substituted alkyl, there is also a cation present to balance the charge.

An essential component of the high-contrast silver halide photographic elements of this invention is a gold compound that functions as a chemical sensitizer. The use of gold compounds as chemical sensitizers is very well known in the art. (See for example, U.S. Pat. Nos. 3,297,446 and 3,503,749). Gold compounds useful as chemical sensitizers in this invention include:

gold chloride,
gold sulfide,
gold iodide,
potassium tetrachloroaurate,
potassium aurothiocyanate,
aurous dithiosulfate
and the like A preferred class of gold compounds for use as chemical sensitizers in this invention are the gold (I) compounds described in copending, commonly assigned U.S. patent application Ser. No. 614,536 filed Nov. 16, 1990, "Photographic Silver Halide Material Comprising Gold Compound", by J. C. Deaton and issued Sep. 17, 1991, as U.S. Pat. No. 5,049,485, the disclosure of which is incorporated herein by reference. These are compounds of the formula:

$$AuL_2^+X^- \text{ or } AuL(L^1)^+X^-$$

wherein

L is a mesoionic compound;

X is an anion; and $L^1$ is a Lewis donor ligand.

Preferably L is represented by the formula:

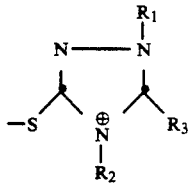

wherein $R_1$, $R_2$ and $R_3$ individually are hydrogen or a hydrocarbon group.

A particularly preferred species is aurous bis(1,4,5-trimethyl-1,2,4-triazolium-3-thiolate) tetrafluoroborate, which has the formula:

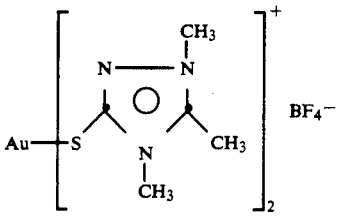

A second preferred class of gold compounds for use as chemical sensitizers in this invention are the gold (I) compounds described in copending commonly assigned U.S. patent application Ser. No. 614,537, filed Nov. 16, 1990, "Photographic Silver Halide Material And Process", by J. C. Deaton and issued Sep. 17, 1991, as U.S. Pat. No. 5,049,484, the disclosure of which is incorporated herein by reference. These are compounds of the formula:

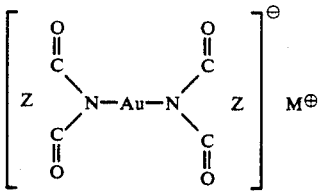

wherein Z represents the substituted or unsubstituted nitrogen and carbon atoms necessary to complete a 5-or 6 member imide nucleus; and M is a cation, preferably sodium, tetraethyl ammonium or potassium. The protonated form of the imide nucleus preferably has a pKa in the range of 7 to 12, and more preferably 8 to 11.

Z is preferably

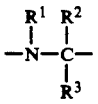

wherein $R^1$, $R^2$ and $R^3$ individually are hydrogen or a hydrocarbon group, preferably a substituted or unsubstituted hydrocarbon group containing 1 to 15 carbon atoms, such as an alkyl group, for example, methyl, ethyl, propyl, n-butyl and t-butyl, and octyl groups, or phenyl groups. $R^3$ is preferably hydrogen.

A particularly preferred species is bis(1-methylhydantoinato) gold (I) sodium salt, which has the formula:

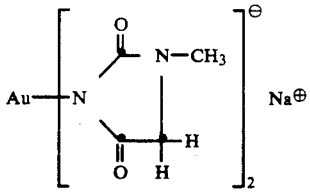

As hereinabove described, the present invention is based on the discovery that certain urea compounds used in combination with gold compounds are highly effective chemical sensitizers for high contrast photographic elements which employ high-chloride silver halide grains and which, in accordance with the teachings of U.S. Pat. No. 4,975,354, include both a hydrazine compound which functions as a nucleator and an amino compound which functions as a booster. These high contrast elements are of a highly complex nature, and utilize the conjoint action of both a nucleator and an incorporated booster. Their performance is affected by the interaction of many variables and the manner in which emulsion addenda, such as chemical sensitizers, will function in such a complex system is unpredictable.

The urea compounds utilized as chemical sensitizers in this invention are described in Burgmaier, U.S. Pat. No. 4,810,626 issued Mar. 7, 1989, the disclosure of which is incorporated herein by reference. These are 1,1,3,3-tetrasubstituted middle chalcogen urea compounds, wherein at least one substituent comprises a nucleophilic center. They can be represented by the formula:

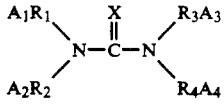

wherein

X is a middle chalcogen atom, i.e., a Group VI A atom below oxygen and above polonium;

each of $R_1$, $R_2$, $R_3$ and $R_4$ independently can represent an alkylene, cycloalkylene, carbocyclic arylene, heterocyclic arylene, alkarylene or aralkylene group; or taken together with the nitrogen atom to which they are attached, $R_1$ and $R_2$ or $R_3$ and $R_4$ can complete a 5 to 7 member heterocyclic ring; and each of $A_1$, $A_2$, $A_3$ and $A_4$ independently is hydrogen or represents a carboxylic, sulfinic, sulfonic, hydroxamic, mercapto, sulfonamido or primary or secondary amino nucleophilic group;

with the proviso that at least one of $A_1R_1$ to $A_4R_4$ contains the nucleophilic group bonded to a urea nitrogen atom through a 2 or 3 member chain.

Sulfur is the preferred Group VI A atom due to ready availability of starting materials for thiourea synthesis and greater solubility of the thiourea compound in aqueous solutions where silver halide sinsitization occurs.

The term "nucleophilic" group, as employed herein, refers to an atom such as an oxygen atom of oxygen acids, a sulfur atom of sulfur acids and a nitrogen atom of nitrogen acids or of a primary or secondary amine.

Such nucleophilic groups comprise carboxylic (—COOH), sulfinic (—$SO_2H$), sulfonic (—$SO_3H$), hydroxamic (—NHOH), mercaptan (—SH), sulfonamido (—$SO_2NH$—) and primary and secondary amines.

Inorganic or organic salts of these acids are equally useful.

Preferably, at least one of $R_1A_1$ to $R_4A_4$ is an omega-bound methyl or ethyl carboxylic acid or a salt thereof.

Other than a nucleophilic group as defined above, which is necessary for successful chemical sensitization of silver halide and which is attached to the urea nitrogen through a two or three member chain, the composition of the remaining RA groups on the 1,1,3,3-tetrasubstituted urea compound can vary widely for achieving the desired chemical sensitization of silver halides.

Alkylene groups which can be represented by at least one of $R_1$ to $R_4$ which are not bonded to the required nucleophilic group can contain from 1 to 6 carbon atoms, preferably from 1 to about 4 carbon atoms for greater solubility properties.

When the $R_1$ to $R_4$ groups are cycloalkylene, the ring portion can contain from about 3 to about 8, preferably about 5 or 6 carbon atoms. Where a cycloalkylene group has the required nucleophilic group bonded thereto, it is important for successful operation of this invention that such group be bonded to one of the urea nitrogen atoms through a 2 or 3 member chain.

Where one of the $R_1$ to $R_4$ groups is an aromatic heterocyclic or an aromatic carbocyclic ring, such ring system can comprise from about 5 to about 10 atoms in the ring, such as for example pyrrole, phenyl, naphthyl, pyridinyl, quinolyl and naphthryl. When the aromatic heterocyclic or aromatic carbocyclic group has bonded thereto the required nucleophilic group, the chain separating the nucleophilic group from a urea nitrogen atom comprises from 2 to 3 members.

Where an $R_1$ to $R_4$ group is an alkarylene or aralkylene, the alkylene moiety thereof can comprise from about 1 to about 3 carbon atoms and the aryl portion is an aromatic group as described above. When the required nucleophilic group is bonded to an aralkylene group, the chain separating the nucleophilic group from a urea nitrogen atom comprises from 2 to 3 atoms.

Heterocyclic rings which can be formed by a urea nitrogen atom with $R_1$ and $R_2$ or with $R_3$ and $R_4$ can comprise 5 or 6 ring members. Typical heterocyclic rings so formed include pyridine, morpholine, piperdine and diazine.

Specific 1,1,3,3-tetrasubstituted-2-thiourea compounds useful in this invention include the following:

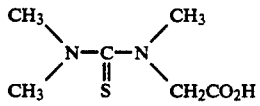

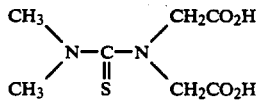

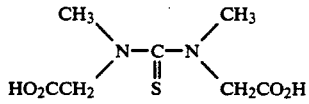

-continued

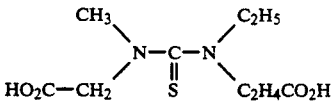

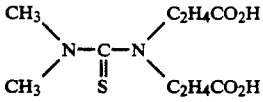

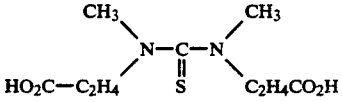

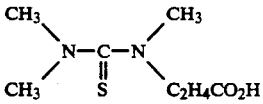

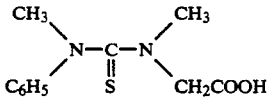

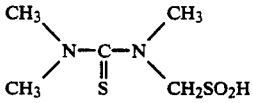

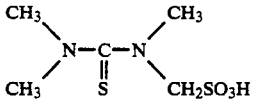

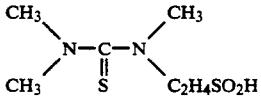

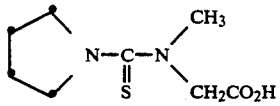

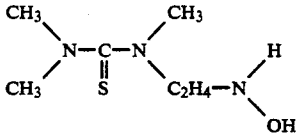

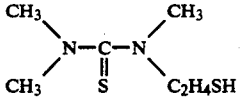

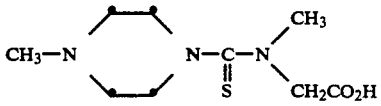

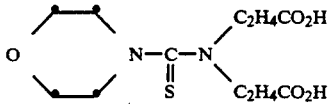

-continued

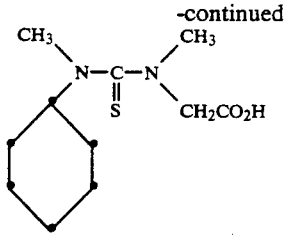

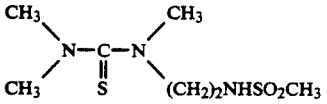

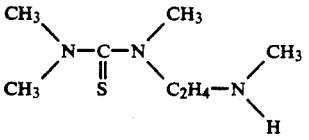

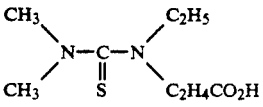

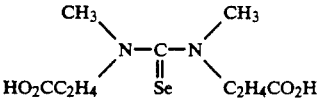

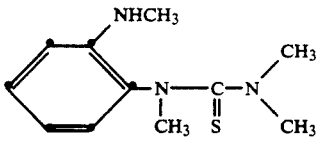

The urea compound is typically employed in this invention in an amount of from about 0.001 to about 10 millimoles per mole of silver, and preferably in an amount of from about 0.003 to about 0.04 millimoles per mole of silver. The gold compound is typically employed in an amount of from about 0.0001 to about 10 millimoles per mole of silver, and preferably in an amount of from about 0.0005 to about 0.04 millimoles per mole of silver. Preferably the molar ratio of the urea compound to the gold compound is greater than one.

The 1,1,3,3-tetra-substituted middle chalcogen urea compounds employed in this invention and their use as chemical sensitizing agents are disclosed in Burgmaier et al, U.S. Pat. No. 4,810,626, issued Mar. 7, 1989. As described in this patent, these compounds are very effective chemical sensitizers for silver halide materials. However, it has not previously been known to use these sensitizers in high-contrast photographic elements containing a hydrazine compound that functions as a nucleator, and it was unexpected and surprising to find that these compounds would function in such elements to not only enhance speed, but also increase toe contrast without causing an increase in fog level.

It should be noted that conventional sulfur sensitizers, such as sodium thiosulfate, are relatively ineffective in the high contrast photographic elements of this invention, even when used in combination with gold compounds.

The term "partition coefficient", as used herein, refers to the log P value of the compound with respect to the system n-octanol/water as defined by the equation:

$$\log P = \log \frac{[X]_{octanol}}{[X]_{water}}$$

where X=concentration of the compound. The partition coefficient is a measure of the ability of a compound to partition between aqueous and organic phases and is calculated in the manner described in an article by A. Leo, P. Y. C. Jow, C. Silipo and C. Hansch, Journal of Medicinal Chemistry, Vol. 18, No. 9, pp. 865–868, 1975. Calculations for log P can be carried out using MedChem software, version 3.54, Pomona College, Claremont, Calif. The higher the value of log P the more hydrophobic the compound. Compounds with a log P of greater than zero are hydrophobic, i.e., they are more soluble in organic media than in aqueous media, whereas compounds with a log P of less than zero are hydrophilic. A compound with a log P of one is ten times more soluble in organic media than in aqueous media and a compound with a log P of two is one hundred times more soluble in organic media than in aqueous media.

The following control tests and examples are provided to further illustrate the invention.

CONTROL 1

A 0.22 micron edge length AgClBr (70/30) photographic emulsion, rhodium-doped at 0.033 mg/Ag mole, was chemically sensitized with 1.6 mg/Ag mole of sodium thiosulfate pentahydrate plus 2.7 mg/Ag mole of potassium tetrachloroaurate for 30 minutes at 65° C. In order to reduce R-typing, 0.14 mg/Ag mole of bis(2-amino-5-iodopyridine-dihydroiodide) mercuric iodide was incorporated in the emulsion. The following addenda were also incorporated in the emulsion:

(1) 204 mg/Ag mole of a sensitizing dye of the formula:

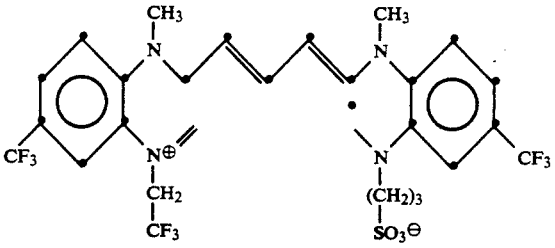

(2) 400 mg/Ag mole of the antifoggant 5-carboxy-4-hydroxy-6-methyl-2-methylmercapto-1,3,3a,-7-tetraazaindene, (3) 100 mg/Ag mole of the antifoggant 5-bromo-4-hydroxy-6-methyl-1,3,3a,7-tetraazaindene, (4) 40 mg/Ag mole of the stabilizer 1-(3-acetamidophenyl)-5-mercaptotetrazole, (5) 2 g/Ag mole of a booster of the formula:

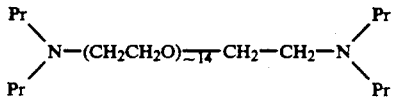

where Pr represents n-propyl and (6) 0.2 mmole/Ag mole of a nucleator of the formula:

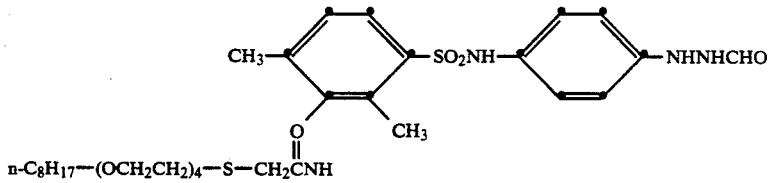

The emulsion was coated on a polyester support to give a silver laydown of 3.2 g/m$^2$, a gelatin laydown of 2.5 g/m$^2$, and a latex laydown of 0.36 g/m$^2$, where the latex is a copolymer of methyl acrylate, 2-acrylamido-2-methylpropane sulfonic acid and 2-acetoacetoxy-ethylmethacrylate. The emulsion layer was overcoated with gelatin hardened with 2 weight percent of bis(vinylsulfonylmethyl) ether, and coated at a laydown of 0.82 g/m$^2$.

CONTROL 2

This was the same as Control 1, except that 300 mg/Ag mole of potassium iodide was added to the emulsion before chemical sensitization.

EXAMPLE 1

This was the same as Control 1, except that chemical sensitization was carried out for 10 minutes at 65° C., utilizing 1.8 mg/Ag mole of 1,3-dicarboxymethyl-1,3-dimethyl-2-thiourea and 1.2 mg/Ag mole of potassium tetrachloroaurate.

EXAMPLE 2

This was the same as Example 1, except that 300 mg/Ag mole of potassium iodide was added to the emulsion before chemical sensitization.

Each of the four films described above was exposed for 0.5 seconds by a 3000° K. tungsten source through a continuous wedge target, and developed for 35 seconds at 35° C.

To prepare the developer solution, a concentrate was prepared from the following ingredients:

| | |
|---|---|
| Sodium metabisulfite | 145 g |
| 45% Potassium hydroxide | 178 g |
| Diethylenetriamine pentaacetic acid pentasodium salt (40% solution) | 15 g |
| Sodium bromide | 12 g |
| Hydroquinone | 65 g |
| 1-Phenyl-4-hydroxymethyl-4-methyl-3-pyrazolidone | 2.9 g |
| Benzotriazole | 0.4 g |
| 1-Phenyl-5-mercaptotetrazole | 0.05 g |
| 50% Sodium hydroxide | 46 g |
| Boric acid | 6.9 g |
| Diethylene glycol | 120 g |
| 47% Potassium Carbonate | 120 g |
| Water to one liter | |

The concentrate was diluted at a ratio of one part of concentrate to two parts of water to produce a working strength developing solution with a pH of 10.5.

The speed of the film, measured at 0.1 density above gross fog and expressed in log units, is referred to below as the (0.1) Speed. The difference in Log E of the speeds at 0.1 and 4.0 above gross fog was also measured, and is referred to below as the (0.1–4) Speed. This is a measure of the separation of toe and shoulder speeds. Toe contrast, defined as the slope of the line joining the points on the H&D curve at 0.1 and 0.6 density units above gross fog, and referred to as "Toe Gamma", was also calculated. The results obtained are summarized in Table I below.

TABLE I

| Film | Gross Fog | (0.1) Speed | (0.1–4) Speed | Toe Gamma |
|---|---|---|---|---|
| Control 1 | 0.042 | 1.97 | 0.29 | 4.1 |
| Control 2 | 0.065 | 2.18 | 0.35 | 2.8 |
| Example 1 | 0.040 | 2.11 | 0.23 | 5.2 |
| Example 2 | 0.042 | 2.04 | 0.27 | 4.6 |

Comparing Control 2 with Control 1, it is seen that the addition of potassium iodide gave a significant toe speed increase, but at the expense of increased fog, an increased value for (0.1–4) Speed and a reduced value for toe gamma. Low toe speed, low toe contrast, high fog and high values for (0.1–4) Speed are all undesirable for graphic arts applications. Comparing Example 1 with Control 1, it is seen that use of 1,3-dicarboxymethyl-1,3-dimethyl-2-thiourea as a chemical sensitizing agent, in accordance with this invention, gave both increased toe speed and increased toe gamma without any increase in fog. It also gave a reduced value for (0.1–4) Speed. Comparing Example 2 with Example 1, it is seen that the use of potassium iodide did not provide any benefit with the AgClBr(70/30) emulsion utilized in these examples.

CONTROL 3

This was the same as Control 1 with the following exceptions:

(1) the emulsion was a 0.22 micron edge length AgCl emulsion doped with rhodium in an amount of 0.0094 mg of rhodium per Ag mole, (2) the emulsion was chemically sensitized with 3 mg/Ag mole of sodium thiosulfate pentahydrate plus 4.5 mg/Ag mole of potassium tetrachloroaurate for 10 minutes at 65° C., and (3) the amount of 1-(3-acetamidophenyl)-5-mercaptotetrazole was 50 mg/Ag mole.

CONTROL 4

This was the same as Control 3, except that 300 mg/Ag mole of potassium iodide was added to the emulsion before chemical sensitization.

EXAMPLE 3

This was the same as Control 3, except that chemical sensitization was carried out with 2.0 mg/Ag mole of the sodium salt of 1,3-dicarboxymethyl-1,3-dimethyl-2-thiourea and 1.8 mg/Ag mole of potassium tetrachloroaurate.

EXAMPLE 4

This was the same as Example 3, except that 300 mg/Ag mole of potassium iodide was added to the emulsion before chemical sensitization.

EXAMPLE 5

This was the same as Example 3, except that the gold sensitizer utilized was 2.7 mg/Ag mole of aurous bis(1,4,5-trimethyl-1,2,4-triazolium-3-thiolate)tetrafluoroborate.

EXAMPLE 6

This was the same as Example 5, except that 300 mg/Ag mole of potassium iodide was added to the emulsion before chemical sensitization.

EXAMPLE 7

This was the same as Example 3, except that the urea compound utilized was 1.6 mg/Ag mole of 1-carboxymethyl-1,3,3-trimethyl-2-thiourea.

Each of the films for Control Tests 3 and 4 and Examples 3 to 7 was exposed for 0.5 seconds to a 3000° K. tungsten light source through a continuous wedge target, and developed for 30 seconds at 35° C. The developing solution was prepared by diluting the concentrate at a ratio of one part of concentrate to four parts of water. Measurements were made to determine (0.1) Speed, (0.1–4) Speed, toe gamma and number of pepper fog spots. An electronic image analyzer was used to scan processed unexposed samples and count the number of pepper fog spots (>10 micrometer diameter) contained in an area of 600 square millimeters. The results obtained are summarized in Table II below.

TABLE II

| Film | Number of Pepper Fog Spots | (0.1) Speed | (0.1–4) Speed | Toe Gamma |
|---|---|---|---|---|
| Control 3 | 4 | 2.12 | 0.31 | 10.5 |
| Control 4 | 14 | 2.19 | 0.26 | 12.7 |
| Example 3 | 5 | 2.18 | 0.23 | 13.6 |
| Example 4 | 34 | 2.19 | 0.22 | 12.9 |
| Example 5 | 5 | 2.17 | 0.22 | 13.7 |
| Example 6 | 48 | 2.21 | 0.23 | 13.6 |
| Example 7 | 25 | 2.22 | 0.27 | 11.3 |

Comparing Control 4 with Control 3, it is seen that the addition of potassium iodide resulted in higher pepper fog, toe speed and toe contrast while reducing (0.1–4) speed. Comparing Example 3 with Control 3, it is seen that use of the sodium salt of 1,3-dicarboxymethyl-1,3-dimethyl-2-thiourea as a chemical sensitizing agent, in accordance with this invention, gave higher toe speed and contrast, comparable pepper fog and lower (0.1–4) speed. Comparing Example 5 with Example 3, it is seen that use of a different gold sensitizer made no difference to the advantageous performance of the urea compound. Comparing Example 4 with Example 3 and Example 6 with Example 5, it is seen that addition of 300 mg/Ag mole of potassium iodide increased pepper fog without yielding useful sensitometric improvements. Comparing Example 7 with Control 3, it is seen that use of 1-carboxymethyl-1,3,3-trimethyl-2-thiourea as a chemical sensitizing agent, in accordance with this invention, gave higher toe speed, higher contrast and lower (0.1–4) speed but somewhat higher pepper fog.

Consideration of all of the above examples indicates that use of the combination of chemical sensitizers of this invention provides the desired combination of very good toe speed coupled with low fog, high toe contrast and small separation of toe and shoulder speeds. In the particular emulsions evaluated, potassium iodide did not provide a beneficial effect. It can, of course, be employed in combination with the chemical sensitizing agents of this invention in any emulsion where a beneficial effect is achieved.

It should be noted that the present invention is characterized by five critical features which must be employed in combination, namely:

(1) surface latent image forming high-chloride silver halide grains, (2) a hydrazine compound that functions as a nucleator, (3) an amino compound that functions as an incorporated booster, (4) a gold compound that functions as a chemical sensitizer, and (5) a urea compound that functions as a chemical sensitizer, the urea compound being a 1,1,3,3-tetrasubstituted middle chalcogen urea compound in which at least one substituent comprises a nucleophilic center. Use of these five features in combination is highly advantageous in that it provides a photographic element characterized by a desired combination of properties including high speed, very high contrast, low fog and excellent developability.

The invention has been described in detail with particular reference to preferred embodiments thereof, but it will be understood that variations and modifications can be effected within the spirit and scope of the invention.

What is claimed is:

1. A silver halide photographic element adapted to form a high contrast image when developed with an aqueous alkaline developing solution; said element comprising:

(1) surface latent image forming high-chloride silver halide grains, (2) a hydrazine compound that functions as a nucleator, (3) an amino compound that functions as an incorporated booster, (4) a gold compound that functions as a chemical sensitizer, and (5) a urea compound that functions as a chemical sensitizer, said urea compound being a 1,1,3,3-tetrasubstituted middle chalcogen urea compound in which at least one substituent comprises a nucleophilic center.

2. A silver halide photographic element as claimed in claim 1 wherein said silver halide grains are at least 70 mole per cent silver chloride.

3. A silver halide photographic element as claimed in claim 1 wherein said silver halide grains have a mean grain size of about 0.4 micrometers or less.

4. A silver halide photographic element as claimed in claim 1 wherein said silver halide grains include a doping agent which enhances contrast.

5. A silver halide photographic element as claimed in claim 1 wherein said silver halide grains are rhodium-doped.

6. A silver halide photographic element as claimed in claim 1 wherein said hydrazine compound is an aryl sulfonamidophenyl hydrazide of the formula:

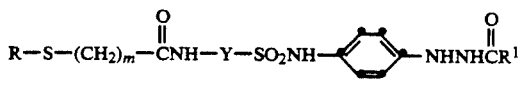

where R is a monovalent group comprised of at least three repeating ethyleneoxy units, m is 1 to 6, Y is a divalent aromatic radical, and $R^1$ is hydrogen or a blocking group.

7. A silver halide photographic element as claimed in claim 1 wherein said amino compound is a compound which (1) comprises at least one secondary or tertiary amino group, (2) contains within its structure a group comprised of at least three repeating ethyleneoxy units, and (3) has a partition coefficient of at least one.

8. A silver halide photographic element as claimed in claim 1 wherein said amino compound is a bis-tertiary amine of the formula:

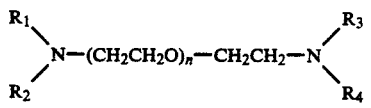

wherein n is an integer with a value of 3 to 50, $R_1$, $R_2$, $R_3$ and $R_4$ are independently alkyl groups of 1 to 8 carbon atoms, $R_1$ and $R_2$ taken together and $R_3$ and $R_4$ taken together represent the atoms necessary to complete a heterocyclic ring.

9. A silver halide photographic element as claimed in claim 1 wherein said amino compound is a bis-secondary amine of the formula:

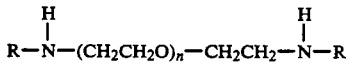

wherein n is an integer with a value of 3 to 50 and each R is independently a linear or branched, substituted or unsubstituted alkyl group of at least 4 carbon atoms.

10. A silver halide photographic element as claimed in claim 1 wherein said gold compound is potassium tetrachloroaurate.

11. A silver halide photographic element as claimed in claim 1 wherein said gold compound is aurous bis(1,4,5-trimethyl-1,2,4-triazolium-3-thiolate)tetrafluoroborate.

12. A silver halide photographic element as claimed in claim 1 wherein said urea compound is represented by the formula:

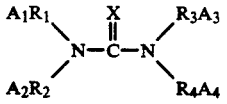

wherein

X is a middle chalcogen atom;

each of $R_1$, $R_2$, $R_3$ and $R_4$ independently can represent an alkylene, cycloalkylene, carbocyclic arylene or heterocyclic arylene, alkarylene or aralkylene group; or taken together with the nitrogen atom to which they are attached, $R_1$ and $R_2$ or $R_3$ and $R_4$ can complete a 5 to 7 member heterocyclic ring; and each of $A_1$, $A_2$, $A_3$ and $A_4$ independently is hydrogen or represents a carboxylic, sulfinic, sulfonic, hydroxamic, mercapto, sulfonamido or primary or secondary amino nucleophilic group;

with the proviso that at least one of $A_1R_1$ to $A_4R_4$ contains a nucleophilic group bonded to a urea nitrogen atom through a 2 or 3 member chain.

13. A silver halide photographic element as claimed in claim 1 wherein said urea compound is 1,3-dicarboxymethyl-1,3-dimethyl-2-thiourea.

14. A silver halide photographic element as claimed in claim 1 wherein said urea compound is 1-carboxymethyl-1,3,3-trimethyl-2-thiourea.

15. A silver halide photographic element as claimed in claim 1 wherein said hydrazine compound is present in an amount of from about 0.1 to about 10 millimoles per mole of silver, said amino compound is present in an amount of from about 0.1 to about 25 millimoles per mole of silver, said gold compound is present in an amount of from about 0.0001 to about 10 millimoles per mole of silver, and said urea compound is present in an amount of from about 0.001 to about 10 millimoles per mole of silver.

16. A silver halide photographic element as claimed in claim 11 wherein X is sulfur.

17. A silver halide photographic element as claimed in claim 16 wherein said nucleophilic group is a carboxylic group.

18. A silver halide photographic element adapted to form a high contrast image when developed with an aqueous alkaline developing solution, said element comprising:

(1) surface latent image forming high-chloride silver halide grains, (2) a hydrazine compound that functions as a nucleator, said hydrazine compound having the formula:

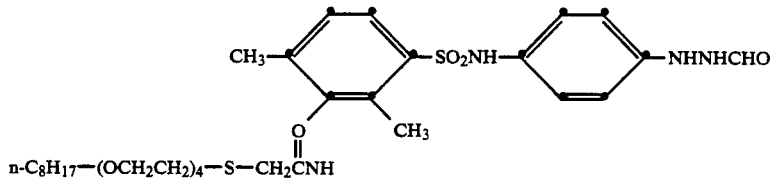

(3) an amino compound that functions as an incorporated booster, said amino compound having the formula:

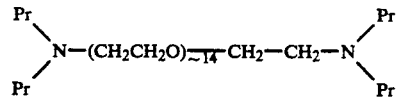

where Pr represents n-propyl, (4) potassium tetrachloroaurate in an amount sufficient to serve as a chemical sensitizer, and (5) 1,3-dicarboxymethyl-1,3-dimethyl-2-thiourea in an amount sufficient to serve as a chemical sensitizer.

19. A silver halide photographic element adapted to form a high contrast image when developed with an aqueous alkaline developing solution, said element comprising:

(1) surface latent image forming rhodium-doped AgClBr (70/30) silver halide grains, (2) a hydrazine compound that functions as a nucleator, said hydrazine compound having the formula:

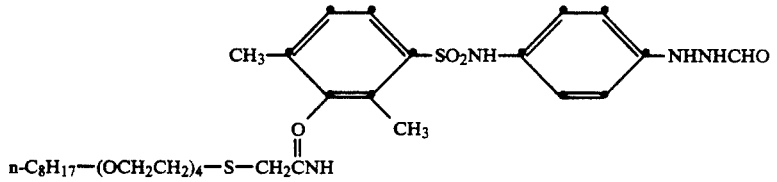

(3) an amino compound that functions as an incorporated booster, said amino compound having the formula:

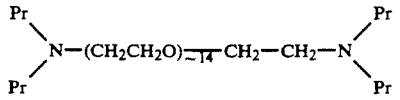

where Pr represents n-propyl, (4) potassium tetrachloroaurate in an amount sufficient to serve as a chemical sensitizer, and (5) 1,3-dicarboxymethyl-1,3-dimethyl-2-thiourea in an amount sufficient to serve as a chemical sensitizer.

* * * * *